US008072127B2

(12) United States Patent
Liu et al.

(10) Patent No.: US 8,072,127 B2
(45) **Date of Patent: *Dec. 6, 2011**

(54) THERMIONIC ELECTRON EMISSION DEVICE

(75) Inventors: Peng Liu, Beijing (CN); Liang Liu, Beijing (CN); Kai-Li Jiang, Beijing (CN); Shou-Shan Fan, Beijing (CN)

(73) Assignees: Tsinghua University, Beijing (CN); Hon Hai Precision Industry Co., Ltd., Tu-Cheng, New Taipei (TW)

( * ) Notice: Subject to any disclaimer, the term of this patent is extended or adjusted under 35 U.S.C. 154(b) by 299 days.

This patent is subject to a terminal disclaimer.

(21) Appl. No.: 12/288,864

(22) Filed: Oct. 23, 2008

(65) Prior Publication Data

US 2009/0167137 A1 Jul. 2, 2009

(30) Foreign Application Priority Data

Dec. 29, 2007 (CN) ..... 2007 1 0125672

(51) Int. Cl.
*H01J 63/04* (2006.01)

(52) U.S. Cl. ..... 313/310

(58) Field of Classification Search ..... 313/495–497, 313/310

See application file for complete search history.

(56) References Cited

U.S. PATENT DOCUMENTS

| | | | | |
|---|---|---|---|---|
| 5,905,335 | A | 5/1999 | Fushimi et al. | |
| 5,955,828 | A * | 9/1999 | Sadwick et al. | 313/310 |
| 6,843,696 | B2 * | 1/2005 | Kitamura et al. | 445/24 |
| 7,034,449 | B2 * | 4/2006 | Suzuki et al. | 313/495 |
| 2002/0030640 | A1 * | 3/2002 | Nomura et al. | 345/45 |
| 2003/0160570 | A1 | 8/2003 | Sasaki et al. | |
| 2006/0208620 | A1 * | 9/2006 | Muneyoshi et al. | 313/311 |
| 2009/0153012 | A1 | 6/2009 | Liu et al. | |
| 2009/0167136 | A1 | 7/2009 | Liu et al. | |
| 2009/0167137 | A1 | 7/2009 | Liu et al. | |

FOREIGN PATENT DOCUMENTS

| | | | |
|---|---|---|---|
| CN | 1440044 | A | 9/2003 |
| CN | 1773664 | A | 5/2006 |
| CN | 101471211 | A | 7/2009 |
| JP | 2005-100757 | | 4/2005 |
| JP | 2009-146896 | | 7/2009 |
| JP | 2009-164119 | | 7/2009 |

OTHER PUBLICATIONS

Cox et al., Thermionic emission from defective carbon nanotubes, Applied Physics Letters, Sep. 13, 2004, pp. 2065-2067, vol. 85, No. 11.

* cited by examiner

*Primary Examiner* — Toan Ton
*Assistant Examiner* — Hana Featherly
(74) *Attorney, Agent, or Firm* — Altis Law Group, Inc.

(57) ABSTRACT

A thermionic electron emission device includes an insulating substrate, and one or more grids located thereon. The one or more grids include(s) a first, second, third and fourth electrode down-leads located on the periphery thereof, and a thermionic electron emission unit therein. The first and second electrode down-leads are parallel to each other. The third and fourth electrode down-leads are parallel to each other. The first and second electrode down-leads are insulated from the third and fourth electrode down-leads. The thermionic electron emission unit includes a first electrode, a second electrode, and a thermionic electron emitter. The first electrode and the second electrode are separately located and electrically connected to the first electrode down-lead and the third electrode down-lead respectively. Wherein the thermionic electron emitter includes a carbon nanotube film structure.

17 Claims, 4 Drawing Sheets

THERMIONIC ELECTRON EMISSION DEVICE

RELATED APPLICATIONS

This application is related to commonly-assigned applications entitled, "METHOD FOR MAKING THERMIONIC ELECTRON SOURCE", filed Oct. 23, 2008, Ser. No. 12/288,861; "THERMIONIC ELECTRON SOURCE", filed Oct. 23, 2008, Ser. No. 12,288,865; "THERMIONIC EMISSION DEVICE", filed Oct. 23, 2008, Ser. No. 12/288,996; "THERMIONIC EMISSION DEVICE", filed Oct. 23, 2008, Ser. No. 12,288/863; and "THERMIONIC ELECTRON SOURCE", filed Oct. 23, 2008, Ser. No. 12/288,862.

BACKGROUND

1. Field of the Invention

The present invention relates to a thermionic electron emission device adopting carbon nanotubes and a method for making the same.

2. Discussion of Related Art

Carbon nanotubes (CNT) are a carbonaceous material and have received much interest since the early 1990s. Carbon nanotubes have interesting and potentially useful electrical and mechanical properties. Due to these and other properties, CNTs have become a significant contributor to the research and development of electron emitting devices, sensors, and transistors, among other devices.

Generally, there are two kinds of electron-emitting devices; field emission device and thermionic electron emission device. The field emission device includes an insulating substrate, and a plurality of grids located thereon. Each grid includes first, second, third and fourth electrode down-leads located on the periphery of the gird. The first and the second electrode down-leads are parallel to each other. The third and fourth electrode down-leads are parallel to each other. The first and the second electrode down-leads are insulated from the third and fourth electrode down-leads.

The thermionic electron emission device, conventionally, comprises a plurality of thermionic electron emission units. Each thermionic electron emission unit includes a thermionic electron emitter and two electrodes. The thermionic electron emitter is located between the two electrodes and electrically connected thereto. The thermionic emitter is generally made of a metal, a boride or an alkaline earth metal carbonate. The thermionic emitter, made of metal, can be a metal ribbon or a metal thread, and is fixed between the two electrodes by welding. The boride or alkaline earth metal carbonate can be dispersed in conductive slurry, wherein the conductive slurry is directly coated or sprayed on a heater. The heater can be secured between the two electrodes as a thermionic electron emitter. However, it is hard to assemble a plurality of thermionic electron emission units, and the assembled thermionic electron emission device cannot realize uniform thermionic emission. Further, the size of the thermionic emitter using the metal, boride or alkaline earth metal carbonate is large, and thereby limits its application in micro-devices. Furthermore, the coating formed by direct coating or from spraying the metal, boride or alkaline earth metal carbonate has a high resistivity, and thus, the thermionic electron source using the same has greater power consumption and is therefore not suitable for applications involving high current density and brightness.

What is needed, therefore, is a thermionic electron emission device and a method for making the same, wherein the thermionic electron emission device has excellent thermal electron emitting properties, and can be used in flat panel displays with high current density and brightness, logic circuits, as well as in other fields using thermionic electron emission devices.

SUMMARY

In one embodiment, a thermionic electron emission device includes an insulating substrate, and one or more grids located thereon. The one or more grids include(s) a first, second, third and fourth electrode down-leads located on the periphery thereof, and a thermionic electron emission unit therein. The first and second electrode down-leads are parallel to each other. The third and fourth electrode down-leads are parallel to each other. The first and second electrode down-leads are insulated from the third and fourth electrode down-leads. The thermionic electron emission unit includes a first electrode, a second electrode, and a thermionic electron emitter. The first electrode and the second electrode are separately located and electrically connected to the first electrode down-lead and the third electrode down-lead respectively. Wherein the thermionic electron emitter includes a carbon nanotube film structure.

Other novel features and advantages of the present thermionic electron emission device and method for making the same will become more apparent from the following detailed description of exemplary embodiments when taken in conjunction with the accompanying drawings.

BRIEF DESCRIPTION OF THE DRAWINGS

Many aspects of the present thermionic electron emission device and method for making the same can be better understood with references to the following drawings. The components in the drawings are not necessarily drawn to scale, the emphasis instead being placed upon clearly illustrating the principles of the present thermionic electron emission device and method for making the same.

Figure 1:
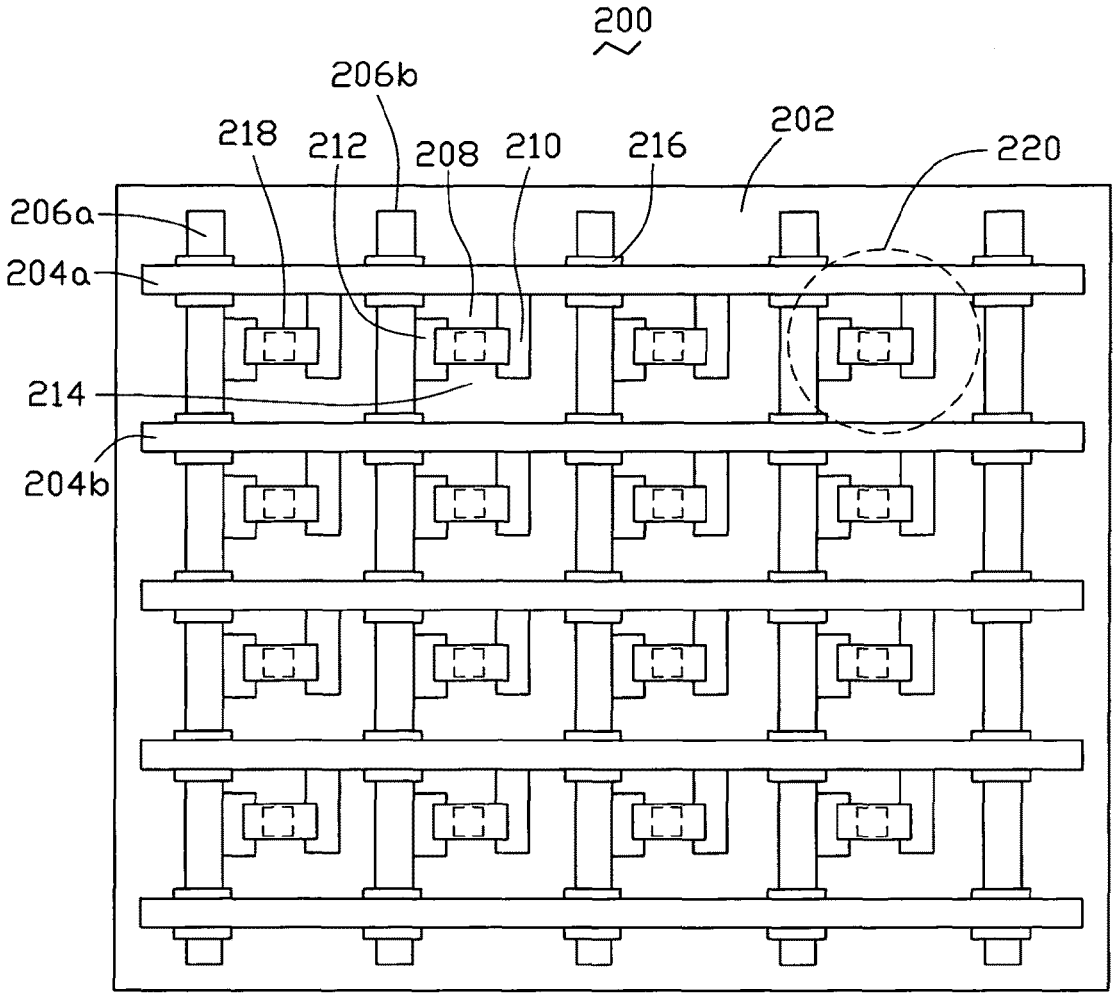
FIG. 1 is an exploded, isometric view of a thermionic electron emission device in accordance with the present embodiment.

Corresponding reference characters indicate corresponding parts throughout the views. The exemplifications set out herein illustrate at least one preferred embodiment of the present thermionic electron emission device and method for making the same, in at least one form, and such exemplifications are not to be construed as limiting the scope of the invention in any manner.

DETAILED DESCRIPTION OF EXEMPLARY EMBODIMENTS

References will now be made to the drawings to describe, in detail, embodiments of the present thermionic electron emission device and method for making the same.

Referring to FIG. 1, a thermionic electron emission device 200 includes an insulating substrate 202, and one or more grids 214 located thereon. Each grid 214 includes a first electrode down-lead 204*a*, a second electrode down-lead

204*b*, a third electrode down-lead 206*a*, a fourth electrode down-lead 206*b* located on the periphery of the gird 214, and a thermionic electron emission unit 220 located in each grid 214. The first electrode down-lead 204*a* and the second electrode down-lead 204*b* are parallel to each other. The third electrode down-lead 206*a* and the fourth electrode down-leads 206*b* are parallel to each other. Furthermore, a plurality of insulating layers 216 is sandwiched between the first and second electrode down-leads 204*a*, 204*b*, and the third and fourth electrode down-leads 206*a*, 206*b* to avoid short-circuiting. It is to be understood that the electrode down-leads of one grid can be a different electrode down-leads to an adjacent gird. For example, the same electrode down-leads can be the first for one grid and a second for an adjacent one.

One thermionic electron emission unit 220 is located in each grid 214. Each thermionic electron emission unit 220 includes a first electrode 210, a second electrode 212, and a thermionic electron emitter 208. The first electrode 210 and the second electrode 212 are separately located in the grid 214, and electrically connected to the thermionic electron emitter 208. The thermionic electron emitter 208 is suspended above the insulating substrate 202 by the first electrode 210 and the second electrode 212. The thermionic electron emitter 208 can be a carbon nanotube film structure. The first electrode 210 is electrically connected to a first electrode down-lead 204*a*. The second electrode 212 is electrically connected to a third electrode down-lead 206*a*. A plurality of grids 214 form an array, the first electrodes 210 in a row of grids 214 are electrically connected to a first electrode down-lead 204*a*, the second electrodes 212 in a column of grids 214 are electrically connected to a third electrode down-lead 206*a*. In the present embodiment, rows are perpendicular to columns.

The insulating substrate 202 is insulative, and can be made of ceramics, glass, resins, or quartz, among other materials. A size and shape of the insulating substrate 202 can be set as desired. In the present embodiment, the insulating substrate 202 is a glass substrate. Thickness of the insulating substrate 202 is greater than 1 millimeter, and length/width of the insulating substrate is greater than 1 centimeter. The insulating substrate 202 can further include a plurality of recesses 218 located on the insulating substrate 202 corresponding to the grids 214. The recesses 218 are all the same size and uniformly-spaced. Part of the thermionic electron emitter 208 is suspended above the surface of the insulating substrate 202 corresponding to the recesses 218. Therefore there is a spacing between the thermionic electron emitter 208 and the insulating substrate 202. Since the spacing has better thermal insulative properties than the direct contact with the substrate, the thermionic electron emitter 208 will transfer less energy applied for heating the insulating substrate 202, and as a result, the thermionic electron emission device 200 will have an excellent thermionic emitting property.

The first through fourth electrode down-leads 204*a*, 204*b*, 206*a*, 206*b* can be conductors, e.g., metal layers. In the present embodiment, the first through fourth electrode down-leads 204*a*, 204*b*, 206*a*, 206*b* are strip-shaped planar conductors formed by a screen-printing method. Widths of the first through fourth down-leads 204*a*, 204*b*, 206*a*, 206*b* approximately range from 30 micrometers to 1 millimeter, and thicknesses thereof approximately range from 5 micrometers to 1 millimeter, and distances therebetween approximately range from 300 micrometers to 5 millimeters. The first electrode down-lead 204*a* and the second electrode down-lead 204*b* cross the third electrode down-lead 206*a* and the fourth electrode down-leads 206*b* respectively. A preferred orientation of the first through fourth electrode down-leads 204*a*, 204*b*, 206*a*, 206*b* is with them set at an angle with respect to each other. The angle approximately ranges from 10° to 90°. In the present embodiment, the angle is 90°. In the present embodiment, the first through fourth electrode down-leads 204*a*, 204*b*, 206*a*, 206*b* can be formed by printing conductive slurry on the insulating substrate 202 via a screen-printing method. The conductive slurry includes metal powder, low-melting glass powder and adhesive. The metal powder can be silver powder, and the adhesive can be ethyl cellulose or terpineol. A weight ratio of the metal powder in the conductive slurry approximately ranges from 50% to 90%. A weight ratio of the low-melting glass powder in the conductive slurry approximately ranges from 2% to 10%. A weight ratio of the adhesive in the conductive slurry approximately ranges from 10% to 40%.

The first electrode 210 and the second electrode 212 can be conductors, e.g., metal layers. In the present embodiment, the first electrode 210 and the second electrode 212 are planar conductors formed by a screen-printing method. Sizes of the first electrode 210 and the second electrode 212 are determined by the size of the grid 214. Lengths of the first electrode 210 and the second electrode 212 approximately range from 30 micrometers to 1 millimeter, widths thereof approximately range from 30 micrometers to 1 millimeter, and thicknesses thereof approximately range from 5 micrometers to 1 millimeter. A distance between the first electrode 210 and the second electrode 212 approximately ranges from 50 micrometers to 1 millimeter. In the present embodiment, a length of the first electrode 210 and the second electrode 212 is 60 micrometers, a width of each is 40 micrometers, and a thickness of each is 20 micrometers. The first electrode 210 and the second electrode 212 can be formed by printing conductive slurry on the insulating substrate 202 via screen-printing. Ingredients of the conductive slurry are the same as the conductive slurry used to form the electrode down-leads.

Figure 2:
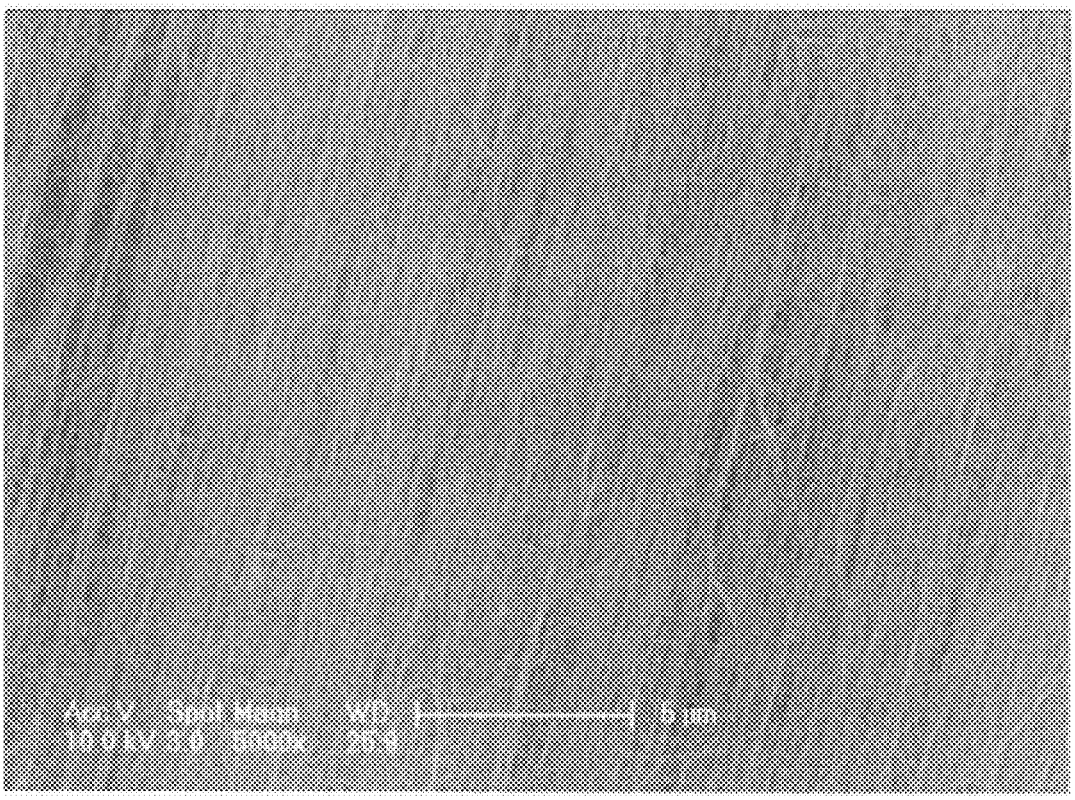
FIG. 2 shows a Scanning Electron Microscope (SEM) image of a carbon nanotube film used in the thermionic electron emission device of FIG. 1.
Figure 3:
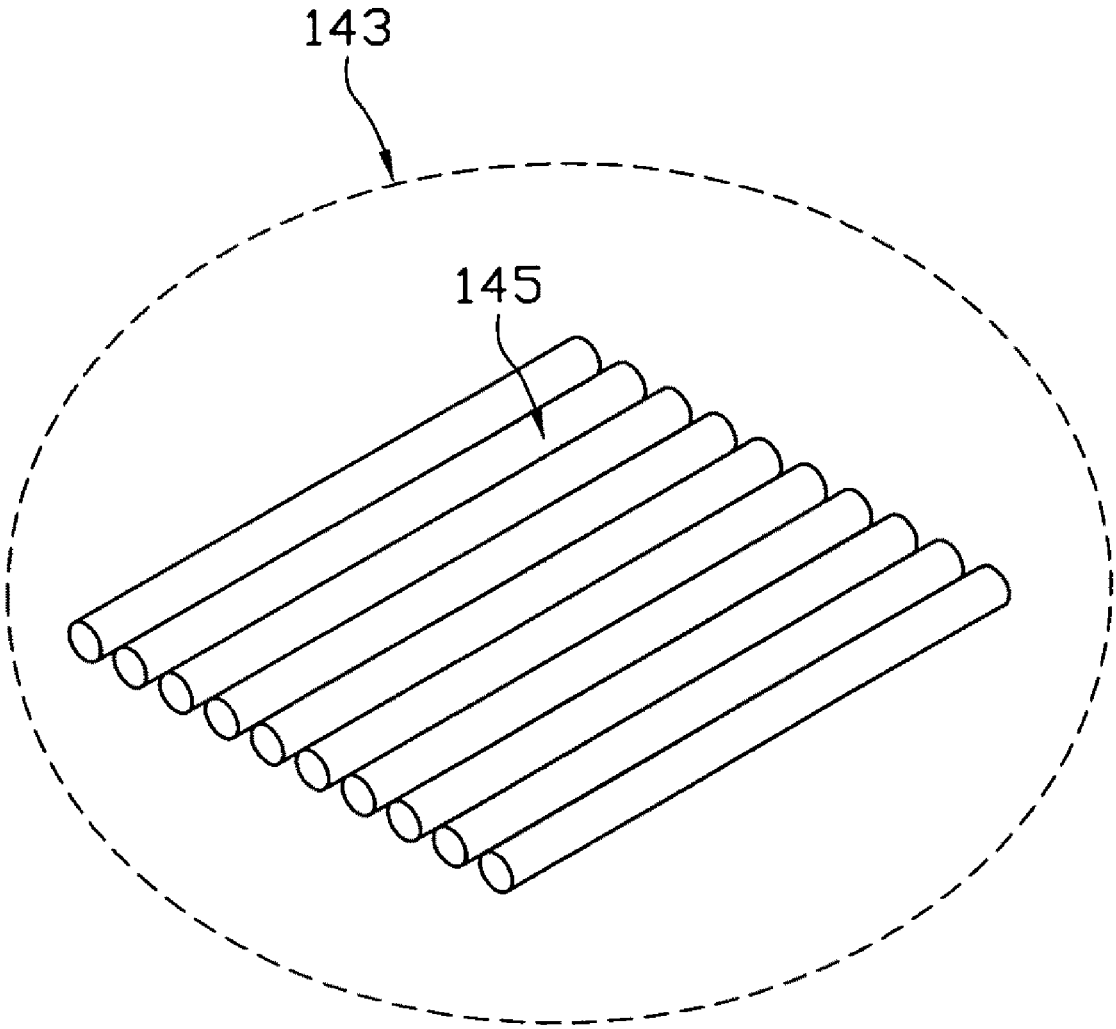
FIG. 3 is a structural schematic of a carbon nanotube segment.

The carbon nanotube film structure includes at least one carbon nanotube film. Referring to FIGS. 2 and 3, each carbon nanotube film comprises a plurality of successively oriented carbon nanotube segments 143 joined end-to-end by van der Waals attractive force. Each carbon nanotube segment 143 includes a plurality of carbon nanotubes 145 parallel to each other, and combined by van der Waals attractive force. The carbon nanotubes 145 in the carbon nanotube film are also oriented along a preferred orientation. The thermionic electron emitter 208 includes a carbon nanotube film, and the carbon nanotubes 145 therein extend from the first electrode 210 to the second electrode 212. In other embodiments, the carbon nanotube film structure includes at least two carbon nanotube films combined by van der Waals attractive force. The films are situated such that an orientation of the carbon nanotubes in one film is at an angle with respect to orientation of the carbon nanotubes in the other film. The angle approximately ranges from 0° to 90°.

In the present embodiment, the carbon nanotube film is acquired by pulling from a carbon nanotube array grown on a 4-inch base. A width of the acquired carbon nanotube film approximately ranges from 0.01 to 10 centimeters. A thickness of the acquired carbon nanotube film approximately ranges from 10 nanometers to 100 micrometers. Furthermore, the carbon nanotube film can be cut into smaller predetermined sizes and shapes. The carbon nanotubes in the carbon nanotube film are selected from a group consisting of single-walled carbon nanotubes, double-walled carbon nanotubes, and multi-walled carbon nanotubes. Diameters of the single-walled carbon nanotubes approximately range from 0.5 to 10 nanometers. Diameters of the double-walled carbon nanotubes approximately range from 1 to 50 nanometers. Diameters of the multi-walled carbon nanotubes approximately range from 1.5 to 50 nanometers. Since the carbon nanotube film has a high surface-area-to-volume ratio, the carbon nanotube film may easily adhere to other objects. Thus, the carbon nanotube film can directly be fixed on the insulating substrate 202 or other carbon nanotube films because of the adhesive properties of the carbon nanotubes. The thermionic electron emitter 208 made by the carbon nanotubes can also be fixed on the insulating substrate 202 via adhesive or conductive glue.

Figure 4:
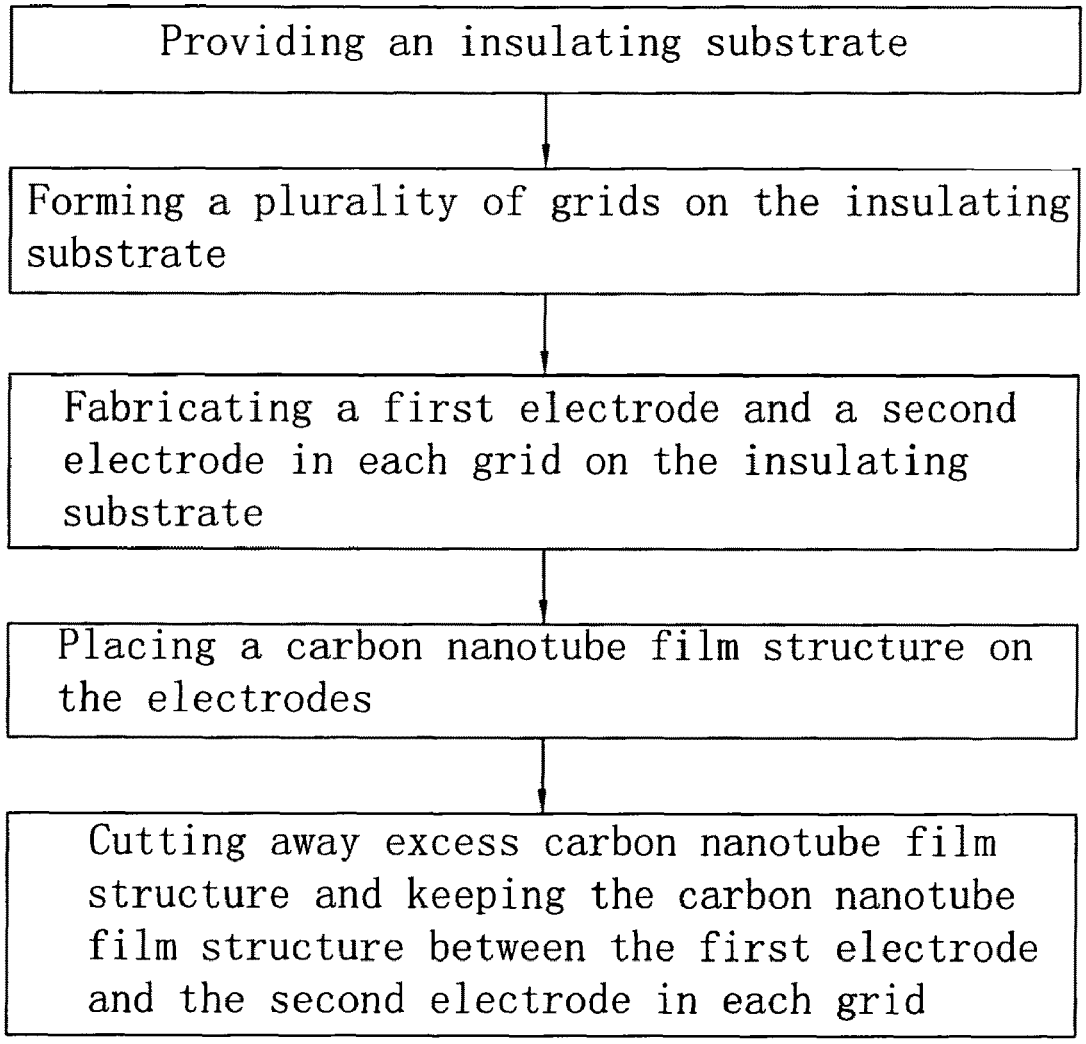
FIG. 4 is a flow chart of a method for making a thermionic electron emission device, in accordance with the present embodiment.

Referring to FIG. 4, a method for making a thermionic electron emission device includes the following steps of: (a) providing an insulating substrate; (b) forming a plurality of grids on the insulating substrate; (c) fabricating a first electrode and a second electrode in each grid on the insulating substrate; (d) placing a carbon nanotube film structure on the electrodes; and (e) cutting away excess carbon nanotube film structure and keeping the carbon nanotube film structure between the first electrode and the second electrode in each grid.

In step (a), the insulating substrate can be made of ceramics, glass, resins, or quartz, among other insulating materials. In the present embodiment, the insulating substrate is a glass substrate. Step (a) can further includes a step of etching a plurality of uniformly-spaced recesses with a predetermined size on the insulating substrate.

Step (b) can be executed by screen printing a plurality of uniformly-spaced first electrode down-leads and second electrode down-leads parallel to each other on the insulating substrate; a plurality of uniformly-spaced insulating layers on the first electrode down-leads and second electrode down-leads; and a plurality of third electrode down-lead, fourth electrode down-leads on the insulating layers parallel to each other on the insulating substrate. The first and second electrode down-leads are insulated from the third and fourth electrode down-leads by the insulating layer at the crossover regions thereof. The first through fourth electrode down-leads can be electrically connected together by a connection external to the grid. It can be understood that the plurality of recesses can also be formed after step (b).

Step (c) can be executed by fabricating a plurality of first electrodes on the first electrode down-lead and a plurality of second electrodes on the third electrode down-lead corresponding to each grid via a screen-printing method, an evaporation method, or a sputtering method.

In step (c), in the present embodiment, a screen-printing method can be used to make the first electrodes and the second electrodes. The first electrode and the second electrode are located a certain distance apart. The first electrode is electrically connected to the first electrode down-lead, and the second electrode is electrically connected to the second electrode down-lead.

Step (d) includes the following steps of: (d1) providing at least one carbon nanotube film; and (d2) applying the at least one carbon nanotube film on the electrodes.

Step (d1) includes the following steps of: (d11) providing an array of carbon nanotubes or super-aligned array of carbon nanotubes; and (d12) pulling out a carbon nanotube film from the array of carbon nanotubes, by using a tool.

In step (d11), a given super-aligned array of carbon nanotubes can be formed by the following substeps: firstly, providing a substantially flat and smooth substrate; secondly, forming a catalyst layer on the substrate; thirdly, annealing the substrate with the catalyst layer thereon in air at a temperature approximately ranging from 700° C. to 900° C. for about 30 to 90 minutes; fourthly, heating the substrate with the catalyst layer to a temperature approximately ranging from 500° C. to 740° C. in a furnace with a protective gas therein; and fifthly, supplying a carbon source gas to the furnace for about 5 to 30 minutes and growing the super-aligned array of carbon nanotubes on the substrate.

The substrate can be a P-type silicon wafer, an N-type silicon wafer, or a silicon wafer with a film of silicon dioxide thereon. In the present embodiment, a 4-inch P-type silicon wafer is used as the substrate. The catalyst can be made of iron (Fe), cobalt (Co), nickel (Ni), or any alloy thereof. The protective gas can be made up of at least one of nitrogen ($N_2$), ammonia ($NH_3$), and a noble gas. In step (a5), the carbon source gas can be a hydrocarbon gas, such as ethylene ($C_2H_4$), methane ($CH_4$), acetylene ($C_2H_2$), ethane ($C_2H_6$), or any combination thereof.

The super-aligned array of carbon nanotubes can be approximately 200 to 400 microns in height and include a plurality of carbon nanotubes parallel to each other and approximately perpendicular to the substrate. The carbon nanotubes in the array can be selected from a group consisting of single-walled carbon nanotubes, double-walled carbon nanotubes, or multi-wall carbon nanotubes. A diameter of the single-walled carbon nanotubes approximately ranges from 0.5 to 50 nanometers. A diameter of the double-walled carbon nanotubes approximately ranges from 1 to 10 nanometers. A diameter of the multi-walled carbon nanotubes approximately ranges from 1.5 to 10 nanometers.

The super-aligned array of carbon nanotubes formed under the above conditions is essentially free of impurities such as carbonaceous or residual catalyst particles. The carbon nanotubes in the super-aligned array are closely packed together by the van der Waals attractive force.

Step (d12) can be executed by selecting a one or more carbon nanotubes having a predetermined width from the array of carbon nanotubes; and pulling the carbon nanotubes to form nanotube segments at an even/uniform speed to achieve a uniform carbon nanotube film.

The carbon nanotube segments can be selected by using an adhesive tape such as the tool to contact with the super-aligned array. The pulling direction is substantially perpendicular to the growing direction of the super-aligned array of carbon nanotubes.

More specifically, during the pulling process, as the initial carbon nanotube segments are drawn out, other carbon nanotube segments are also drawn out end-to-end due to the van der Waals attractive force between ends of adjacent segments. This process of drawing ensures a substantially continuous and uniform carbon nanotube film can be formed. The carbon nanotubes in the carbon nanotube film are all substantially parallel to the pulling/drawing direction of the carbon nanotube film, and the carbon nanotube film produced in such manner can be selectively formed having a predetermined width. The carbon nanotube film formed by the pulling/drawing method has superior uniformity of thickness and conductivity over a disordered carbon nanotube film. Furthermore, the pulling/drawing method is simple, fast, and suitable for industrial applications. It is to be understood that some variation can occur in the orientation of the nanotubes in the film as can be seen in FIG. 2.

Step (d2) can be executed by applying one carbon nanotube film on the electrodes along a direction extending from the first electrode to the second electrode. Step (d2) also can be executed by applying at least two stacked carbon nanotube films on the electrodes situated such that the carbon nanotubes of one film are oriented at an angle with respect to the carbon nanotubes of the adjacent film, the angle approximately ranging from 0° to 90°.

Step (d2) also can be executed by the following steps: (d21) supplying a supporting element; (d22) applying at least two carbon nanotube films side by side on the supporting element along a direction extending from the first electrode to the second electrode to form a carbon nanotube film structure; (d23) cutting away any excess portion of the carbon nanotube film structure; (d24) treating the carbon nanotube film structure with an organic solvent; (d25) removing the carbon nanotube film structure from the supporting element to form a free-standing carbon nanotube film structure; and (d26) applying the free-standing carbon nanotube film structure on the insulating substrate. Step (d2) further includes a step of applying with at least two stacked carbon nanotube films such that orientation of the carbon nanotubes in one film are set at an angle with respect to the carbon nanotubes in the adjacent films to form a carbon nanotube film structure, the angle approximately ranging from 0° to 90°. Since the carbon nanotube film has a high surface-area-to-volume ratio, the carbon nanotube film structure formed by at least one carbon nanotube film may easily adhere to other objects. Thus, the carbon nanotube film can directly be fixed on the insulating substrate due to the adhesive properties of the nanotubes. The carbon nanotube structure can also be secured on the insulating substrate via adhesive or conductive glue.

The carbon nanotube film structure secured on the electrodes can be treated with an organic solvent. The carbon nanotube film structure can be treated by applying organic solvent to soak the entire surface of the carbon nanotube film structure or immersing the carbon nanotube film structure in a container with organic solvent filled therein. The organic solvent is volatilizable and can be selected from the group consisting of ethanol, methanol, acetone, dichloroethane, chloroform, and combinations thereof. In the present embodiment, the organic solvent is ethanol. After being soaked by the organic solvent, microscopically, carbon nanotube strings will be formed by some of the adjacent carbon nanotubes bundling in the carbon nanotube film due to the surface tension of the organic solvent. In one aspect, part of the carbon nanotubes in the untreated carbon nanotube film that are not adhered on the substrate will adhere on the substrate after the organic solvent treatment due to the surface tension of the organic solvent. Then the contacting area of the carbon nanotube film with the substrate will increase, and thus, the treated carbon nanotube film can more firmly adhere to the surface of the substrate. In another aspect, due to the decrease of the specific surface area via bundling, the mechanical strength and toughness of the carbon nanotube film are increased and the coefficient of friction of the carbon nanotube films is reduced. Macroscopically, the film will be an approximately uniform carbon nanotube film.

Further, at least one fixing electrode (not shown), formed on the carbon nanotube film structure corresponding to the first electrode and the second electrode, can be further provided to fix the carbon nanotube film structure on the first electrode and the second electrode firmly.

Step (e) can be executed by a laser ablation method or an electron beam scanning method. In the present embodiment, step (e) is executed by a laser ablation method. Step (e) includes the following steps of: (e1) scanning the carbon nanotube film structure along each first electrode down-lead via a laser beam, and (e2) scanning the carbon nanotube film structure along each third electrode down-lead via a laser beam to cut the carbon nanotube film structure applied on the insulating substrate except that between the first electrodes and the second electrodes. The laser beam has a power approximately ranging from 10 watts to 50 watts and a scanning speed approximately ranging from 10 millimeters/second to 5000 millimeters/second. In the present embodiment, the power of the laser beam is 30 watts; a scanning speed thereof is 100 millimeters/second.

In step (e1), a width of the laser beam is equal to a distance between the adjacent first electrodes along the aligned direction of the third electrode down-lead, and approximately ranges from 20 micrometers to 500 micrometers. Step (e1) is executed to cut the carbon nanotube film structure between adjacent second electrodes in adjacent grid respectively along the aligned direction of the third electrode down-lead. In step (e2), a width of the laser beam is equal to a distance between adjacent first electrode and second electrode in adjacent grid respectively along the aligned direction of the first electrode down-lead, and approximately ranges from 20 micrometers to 500 micrometers. Step (e2) is executed to cut the carbon nanotube film structure between adjacent first electrode and second electrode in adjacent grid respectively along the aligned direction of the first electrode down-lead.

Compared to conventional technologies, the method for making the thermionic electron emission device provided by the present embodiments has many advantages including the following. Firstly, since the carbon nanotube film structure is formed by at least one carbon nanotube film pulled from a carbon nanotube array, the method is simple and low-cost. Secondly, since the carbon nanotubes in the carbon nanotube film structure are uniformly distributed, the thermionic electron emitter adopting the carbon nanotube film structure prepared by the present embodiment can acquire a uniform and stable thermal electron emissions state. Thirdly, since the thermionic electron emitter and the insulating substrate are separately located (a space located therebetween), the insulating substrate will transfer less energy for heating the thermionic electron emitter to the atmosphere in the process of heating, and as a result, the thermionic electron emission device will have an excellent thermionic emitting property. Finally, since the carbon nanotube film structure has a small width and a low resistance, the thermionic electron emission device adopting the carbon nanotube film structure can emit electrons at a low thermal power, thus the thermionic electron emission device can be used for high current density and high brightness of the flat panel display and logic circuits, among other fields.

Finally, it is to be understood that the above-described embodiments are intended to illustrate rather than limit the invention. Variations may be made to the embodiments without departing from the spirit of the invention as claimed. The above-described embodiments illustrate the scope of the invention but do not restrict the scope of the invention.

It is also to be understood that the above description and the claims drawn to a method may include some indication in reference to certain steps. However, the indication used is only to be viewed for identification purposes and not as a suggestion as to an order for the steps.

What is claimed is:

1. A thermionic electron emission device comprising:

an insulating substrate;

one or more grids located on the insulating substrate, wherein the one or more grids comprises:

a first, second, third and fourth electrode down-leads located on the periphery of the one or more grids, wherein the first and the second electrode down-leads are parallel to each other, the third and fourth electrode down-leads are parallel to each other, and the first and the second electrode down-leads are insulated from the third and fourth electrode down-leads respectively; and a thermionic electron emission unit, the thermionic electron emission unit comprises a first electrode, a second electrode, and a thermionic electron emitter, the first electrode and the second electrode separately located and electrically connected to the first electrode down-lead and the third electrode down-lead respectively;

wherein the thermionic electron emitter comprises a continuous carbon nanotube film structure having a first end electrically connected to the first electrode and a second end electrically connected to the second electrode, at least part of the thermionic electron emitter is suspended above the insulating substrate.

2. The thermionic electron emission device as claimed in claim 1, further comprising a plurality of recesses located on a surface of the insulating substrate corresponding to a plurality of grids respectively, each of the plurality of recesses are the same size, and each carbon nanotube film structure is located adjacent to one of the plurality of recesses.

3. The thermionic electron emission device as claimed in claim 1, wherein a plurality of grids form an array, the first electrodes in a row of grids are electrically connected to the first electrode down-lead, the second electrodes in a column of grids are electrically connected to the third electrode down-lead.

4. The thermionic electron emission device as claimed in claim 1, wherein a thickness of the first electrode and the second electrode approximately ranges from 5 micrometers to 1 millimeter, and a distance between the first electrode and the second electrode approximately ranges from 50 micrometers to 1 millimeter.

5. The thermionic electron emission device as claimed in claim 4, wherein the lengths of the first electrode and the second electrode are 60 micrometers, a width of the first electrode and the second electrode are 40 micrometers, and a thickness of the first electrode and the second electrode are 20 micrometers.

6. The thermionic electron emission device as claimed in claim 1, wherein the carbon nanotube film structure comprises at least one layer of carbon nanotube film, and the carbon nanotube film comprises a plurality of carbon nanotubes arranged along a preferred orientation.

7. The thermionic electron emission device as claimed in claim 6, wherein the carbon nanotube film structure comprises a carbon nanotube film, and carbon nanotube film comprises a plurality of carbon nanotubes joined end to end extending from the first electrode to the second electrode.

8. The thermionic electron emission device as claimed in claim 6, wherein the carbon nanotube film structure comprises at least two stacked carbon nanotube films, the carbon nanotube films are situated such that a preferred orientation of the carbon nanotubes is set at an angle with respect to each other, the angle being approximately ranges from 0° to 90°.

9. The thermionic electron emission device as claimed in claim 6, wherein a width of the carbon nanotube film approximately ranges from 0.01 centimeters to 10 centimeters, and a thickness thereof approximately ranges from 10 nanometers to 100 micrometers.

10. The thermionic electron emission device as claimed in claim 6, wherein the carbon each nanotube film comprises a plurality of successive and alike oriented carbon nanotube segments joined end-to-end by van der Waals attractive force therebetween, each carbon nanotube segment comprises a plurality of carbon nanotubes parallel with each other, and the adjacent carbon nanotubes are adhered by van der Waals attractive force therebetween.

11. The thermionic electron emission device as claimed in claim 1, wherein a plurality of insulating layers is sandwiched between the first and second electrode down-leads, and between the third and fourth electrode down-leads.

12. The thermionic electron emission device as claimed in claim 1, wherein the first, second, third and fourth electrode down-leads are strip-shaped planar conductors.

13. The thermionic electron emission device as claimed in claim 12, wherein widths of the first, second, third and fourth electrode down-leads approximately range from 30 micrometers to 1 millimeter; thicknesses of the first, second, third and fourth electrode down-leads approximately range from 5 micrometers to 1 millimeter; a distance between the first and second electrode down-leads, and a distance between the third and fourth electrode down-leads approximately range from 300 micrometers to 5 millimeters.

14. The thermionic electron emission device as claimed in claim 1, wherein an orientation of the first, second, third and fourth electrode down-leads is set at an angle with respect to each other.

15. The thermionic electron emission device as claimed in claim 14, wherein the angle approximately ranges from 10° to 90°.

16. A thermionic electron emission device comprising:

an insulating substrate;

one or more grids located on the insulating substrate, wherein the one or more grids comprises:

a first, second, third and fourth electrode down-leads located on the periphery of the one or more grids, wherein the first and the second electrode down-leads are parallel to each other, the third and fourth electrode down-leads are parallel to each other, and the first and the second electrode down-leads are insulated from the third and fourth electrode down-leads respectively; and a thermionic electron emission unit, the thermionic electron emission unit comprises a first electrode, a second electrode, and a thermionic electron emitter, the first electrode and the second electrode separately located and electrically connected to the first electrode down-lead and the third electrode down-lead respectively;

wherein the thermionic electron emitter comprises a continuous carbon nanotube film structure having a first end electrically connected to the first electrode and a second end electrically connected to the second electrode, the thermionic electron emitter is suspended above the insulating substrate by the first electrode and the second electrode.

17. A thermionic electron emission device comprising:

an insulating substrate;

one or more grids located on the insulating substrate, wherein the one or more grids comprises:

a first, second, third and fourth electrode down-leads located on the periphery of the one or more grids, wherein the first and the second electrode down-leads are parallel to each other, the third and fourth electrode down-leads are parallel to each other, and the first and the second electrode down-leads are insulated from the third and fourth electrode down-leads respectively; and a thermionic electron emission unit, the thermionic electron emission unit comprises a first electrode, a second electrode, and a thermionic electron emitter, the first electrode and the second electrode separately located and electrically connected to the first electrode down-lead and the third electrode down-lead respectively;

wherein the thermionic electron emitter comprises a continuous carbon nanotube film structure having a first end electrically connected to the first electrode and a second end electrically connected to the second electrode, a plurality of recesses is located on a surface of the insulating substrate corresponding to a plurality of grids respectively.

* * * * *